US008490218B1

(12) United States Patent
Thompson

(10) Patent No.: US 8,490,218 B1
(45) Date of Patent: Jul. 23, 2013

(54) BED SOCKS

(76) Inventor: Gary Thompson, Lakewood, CO (US)

( * ) Notice: Subject to any disclaimer, the term of this patent is extended or adjusted under 35 U.S.C. 154(b) by 339 days.

(21) Appl. No.: 12/852,494

(22) Filed: Aug. 8, 2010

(51) Int. Cl.
*A43B 17/00* (2006.01)
*D04B 11/00* (2006.01)

(52) U.S. Cl.
USPC ..... 2/239; 2/409; 66/178 A; 66/182; 66/185

(58) Field of Classification Search
USPC ..... 2/239, 409; 66/178 A, 185, 182, 66/186, 187
See application file for complete search history.

(56) References Cited

U.S. PATENT DOCUMENTS

| | | | | | |
|---|---|---|---|---|---|
| 2,248,303 | A | * | 7/1941 | Morgenroth et al. | 2/239 |
| 2,412,087 | A | * | 12/1946 | Herbert | 66/187 |
| 2,687,528 | A | * | 8/1954 | Paul | 2/61 |
| 3,015,170 | A | | 1/1962 | Kramer | |
| 3,259,915 | A | * | 7/1966 | Dison | 2/239 |
| 4,180,065 | A | * | 12/1979 | Bowen | 602/63 |
| 4,253,317 | A | * | 3/1981 | Howard et al. | 66/186 |
| 4,276,671 | A | | 7/1981 | Melton | |
| 4,277,959 | A | * | 7/1981 | Thorneburg | 66/182 |
| 4,341,096 | A | * | 7/1982 | Safrit et al. | 66/185 |
| 4,520,635 | A | * | 6/1985 | Shields et al. | 66/185 |
| 5,575,013 | A | | 11/1996 | Krack | |
| 5,617,745 | A | * | 4/1997 | Della Corte et al. | 66/178 A |
| 6,044,497 | A | * | 4/2000 | Richardson | 2/239 |
| 6,336,227 | B1 | * | 1/2002 | Liput et al. | 2/239 |
| 6,393,620 | B2 | * | 5/2002 | Hatch et al. | 2/239 |
| D479,766 | S | | 9/2003 | Mays | |
| 7,162,813 | B2 | | 1/2007 | Haft | |
| 7,784,115 | B1 | * | 8/2010 | Nemcik | 2/239 |

* cited by examiner

*Primary Examiner* — Gloria Hale

(57) ABSTRACT

The improved bed sock is a sock specifically designed to be worn on a front half of the foot, which includes varying densities of elasticity throughout a fabric layer. The improved bed sock extends across the toes and down the front part of the Metatarsus, but of which does not extend to the Instep. The improved bed sock includes a specific region of elastic concentration just behind the ball of the foot (the widest part) that aids in maintaining the improved bed sock upon the front foot despite movement of foot while under covers. The improved bed sock is removed while in bed by use of a toe from an opposing foot without requiring the end user to sit up or get out of bed. The improved bed sock keeps the toes warm, but the rear portion of the foot cool.

17 Claims, 3 Drawing Sheets

BED SOCKS

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of socks, more specifically, a specialized pair of socks specifically suited for use in and around a bed.

It is well established that cold toes while in bed can cause restlessness, which can delay the time it takes for a person to get to sleep. During this restless pre-sleep period cold toes are a conscious problem that impedes a person's ability to reach the relaxed semi-conscious state most people need before drifting off to sleep.

A regular sock would normally provide the warmth needed to avoid the cold toe issue, but in themselves creates a second problem, which is removing the socks once the toes are warm. Many people who go to bed with socks on typically wake up with bare feet. Sometime during the night the socks are removed. Overheated feet can lead to a restless night sleep with a lot of unconscious fidgeting as a person moves their feet in an attempt to find a cool spot under the sheets. At some point the person is awaken by their hot feet. With sleep disturbed the person is now awake and removes the socks. Getting back to sleep may be easy for some but may be an additional problem for others. There is also the potential issue of disturbing a person's bed mate while they go through the physical effort of removing the socks and settling back under the covers.

The present invention seeks to overcome the two problems associated with socks being worn in and around a bed by keeping the toes warm and offering an easy means to remove the socks from a virtually semi-conscious state (half-asleep state).

B. Discussion of the Prior Art

As a preliminary note, it should be stated that there is an ample amount of prior art that deals socks generally. As will be discussed immediately below, no prior art discloses a specialized sock that is designed to be worn about the front portion of an end user's foot and of which includes elastic concentrations at predefined locations to aid in maintaining the sock upon the front portion of the foot, and wherein said sock does not cover the entire foot in order to keep the toes warm but allow the skin around the heel portion and rear of said foot to keep cool.

The Hatch et al. Patent (U.S. Pat. No. 6,393,620) discloses a partial sock that only covers the toe portion of the foot. However, the partial sock includes a strap in one embodiment and another embodiment without said strap, but neither of which have a specific region including elastic concentration in order to aid in maintaining the sock upon the front portion of the foot.

The Krack Patent (U.S. Pat. No. 5,575,013) discloses a sock that is made to be easily put on and easily removed. However, the sock covers the entire foot as opposed to a front portion of a foot.

The Haft Patent (U.S. Pat. No. 7,162,813) discloses a flexible slip on foot covering for keeping the toes and top and bottom of a person's foot warm. However, the flexible slip resembles a slipper and not a sock, and also does not include a specific region of elastic concentration.

The Kramer Patent (U.S. Pat. No. 3,015,170) discloses a slipper with a low ankle for easily donning and removing it. However, the slipper covers the entire foot and not a front portion.

The Melton Patent (U.S. Pat. No. 4,276,671) discloses a slip on sock or slipper that can be worn to bed to keep the feet and ankles warm at night. However, the sock is not dedicated to only covering a front portion of the foot.

The Mays et al. Patent (U.S. Pat. No. Des. 479,766) illustrates a design for a toe covering half sock, which depicts a strap that wraps around a heel of an end user.

The Herbert Patent (U.S. Pat. No. 2,412,087) discloses a slip on foot covering apparatus that only covers the toes on the foot. However, the concentrated region of elastic is located adjacent the opening and is not moved forward.

While the above-described devices fulfill their respective and particular objects and requirements, they do not describe a specialized sock that is designed to be worn about the front portion of an end user's foot and of which includes elastic concentrations at predefined locations to aid in maintaining the sock upon the front portion of the foot, and wherein said sock does not cover the entire foot in order to keep the toes warm but allow the skin around the heel portion and rear of said foot to keep cool. In this regard, the improved bed sock departs from the conventional concepts and designs of the prior art.

SUMMARY OF THE INVENTION

The improved bed sock is a sock specifically designed to be worn on a front half of the foot, which includes varying densities of elasticity throughout a fabric layer. The improved bed sock extends across the toes and down the front part of the Metatarsus, but of which does not extend to the Instep. The improved bed sock includes a specific region of elastic concentration just behind the ball of the foot (the widest part) that aids in maintaining the improved bed sock upon the front foot despite movement of said foot while under covers. The improved bed sock is removed while in bed by use of a toe from an opposing foot without requiring the end user to sit up or get out of bed. The improved bed sock keeps the toes warm, but the rear portion of the foot cool.

It is an object of the invention to provide a sock that is specifically suited to cover the front half of a foot such that the front half of the foot and toes keep warm whereas the rear half of the foot can stay cool.

A further object of the invention is to provide a region of elastic concentration that is recessed away from the opening such that the sock extends to cover the front part of the Metatarsus, but of which does not extend to the rear edge of the Metatarsus or into the instep of the foot.

These together with additional objects, features and advantages of the specialized sock will be readily apparent to those of ordinary skill in the art upon reading the following detailed description of presently preferred, but nonetheless illustrative, embodiments of the specialized sock when taken in conjunction with the accompanying drawings.

In this respect, before explaining the current embodiments of the improved bed sock in detail, it is to be understood that the improved bed sock is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the improved bed sock.

It is therefore important that the claims be regarded as including such equivalent construction insofar as they do not depart from the spirit and scope of the improved bed sock. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
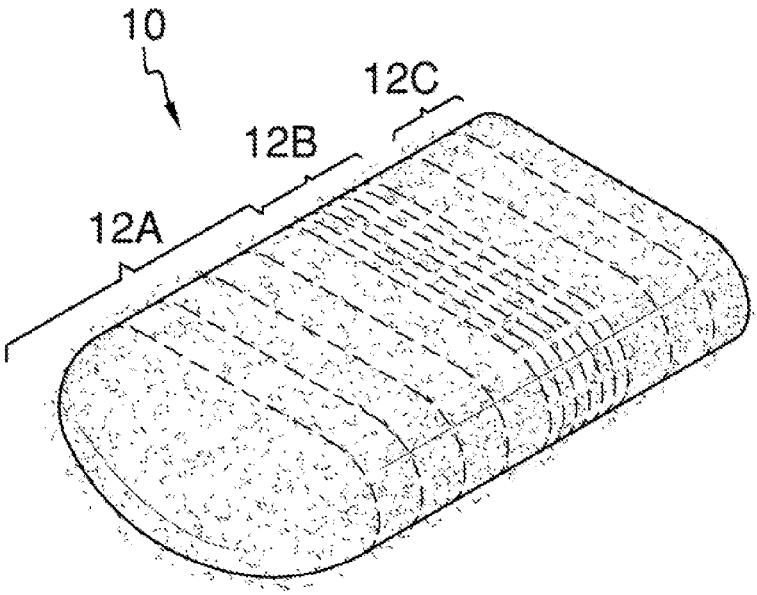
FIG. 1 illustrates a front, isometric view of the improved bed sock by itself in a flattened unused state, and depicting the region with elastic concentration by a grouping of lines.
Figure 2:
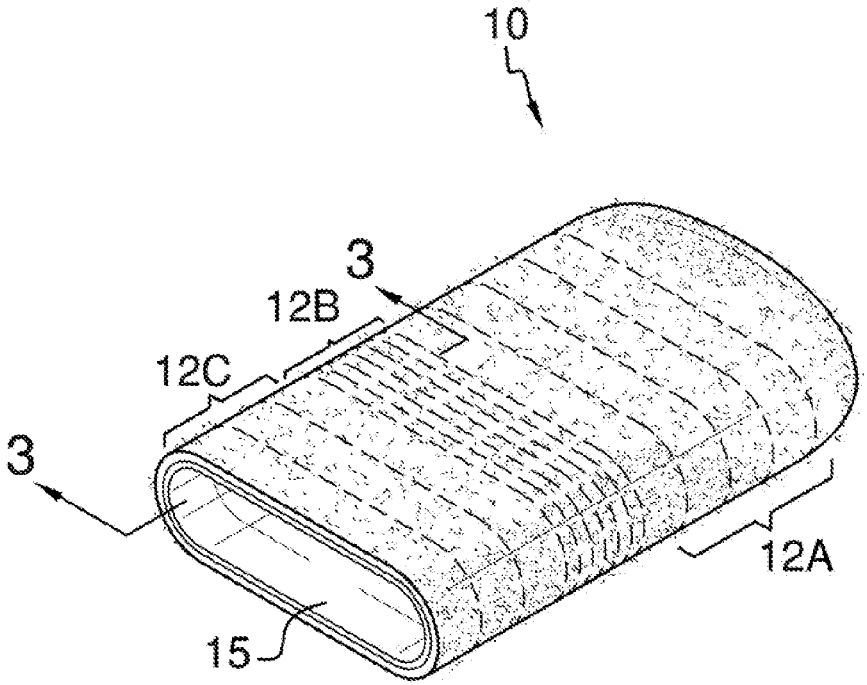
FIG. 2 illustrates a rear, isometric view of the improved bed sock by itself and depicting the opening from which an end user inserts his/her foot therein.
Figure 3:
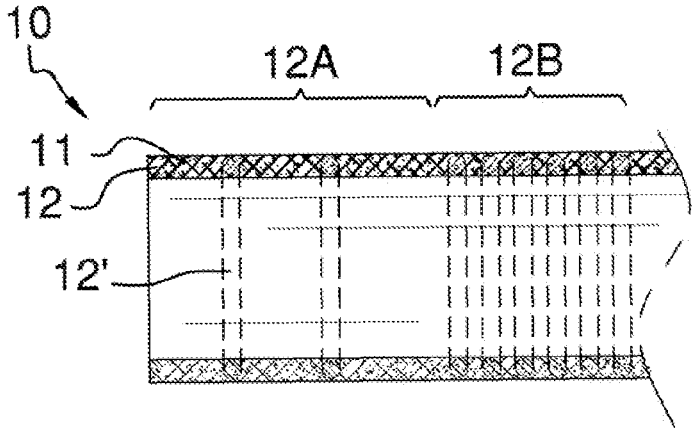
FIG. 3 illustrates a cross-sectional view of the improved bed sock along line 3-3 in FIG. 2, and detailing the region containing the elastic concentration within the fabric layer.
Figure 4:
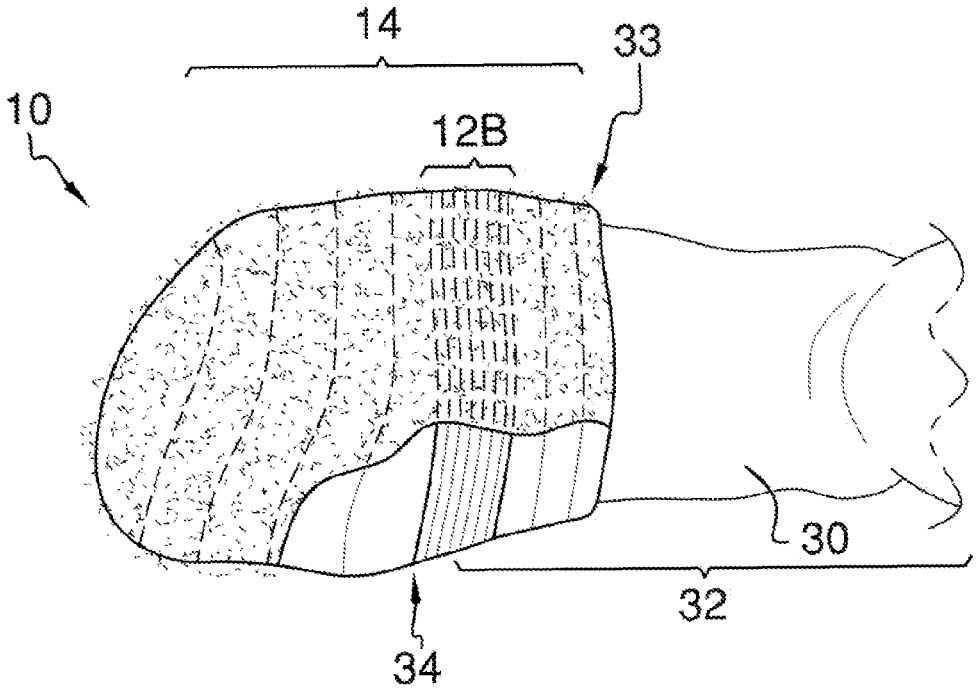
FIG. 4 illustrates a top view of the improved bed sock being worn by an end user and a cut-away depicting the elastic concentration region.
Figure 5:
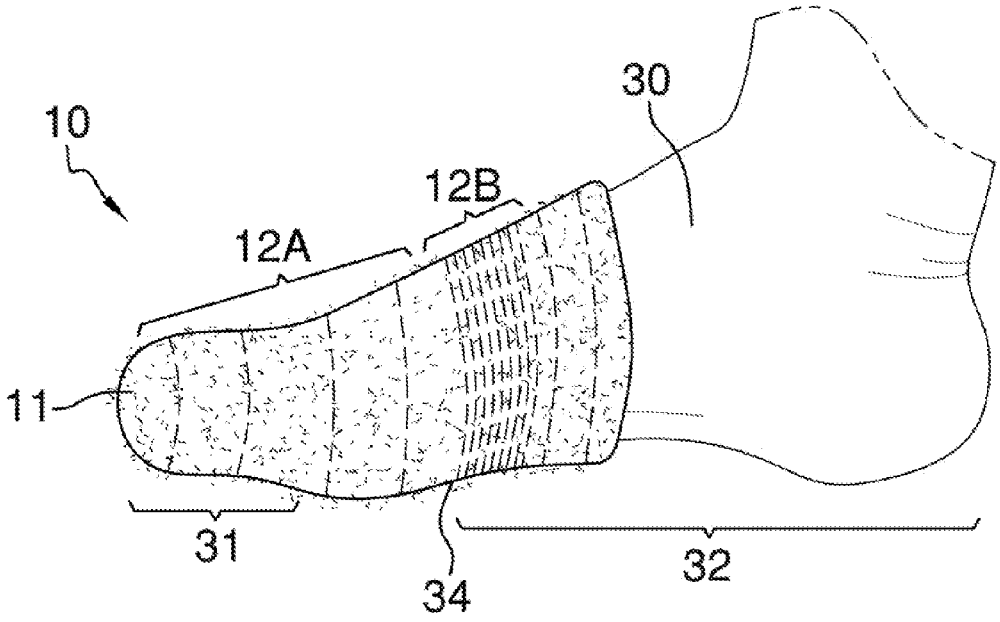
FIG. 5 illustrates a side view of the improved bed sock in use with a foot.

Detailed reference will now be made to the preferred embodiment of the present invention, examples of which are illustrated in FIGS. 1-5. An improved bed sock 10 (hereinafter invention) includes a layer of fabric 11 and an elastic layer 12 integrated therein.

The fabric layer 11 is a layer that is designed to provide warmth to a foot 30. The fabric layer 11 is made of fabrics associated with socks, and comprises polyester, cotton, a blend of polyester and cotton, silk, wool, and nylon.

The elastic layer 12 is a layer of the invention 10 and provides varying concentrations throughout the construction of the invention 10. The elastic layer 12 is integrated into the fabric layer 11 (see FIG. 4). In other words, the elastic layer 11 is interwoven within the fabric layer 11. Both the fabric layer 11 and the elastic layer 12 make up the invention 10, and span a distance 14. The distance 14 is designed to span from toes 31 of said foot 30 down and just beyond the beginning of an instep 32. Another way of defining the distance 14 of the invention 10 is that the invention 10 spans from the toes 31 to an end of the Metatarsus 33.

The elastic layer 12 is comprised of three different regions of elasticity. Each region of the elastic layer 12 involves a plurality of elastic bands 12' that encircle the invention 10. The elastic bands 12' are made of materials well known in the art of elastic fabrics and elastic garments. A toe region 12A spans from a first end of the invention 10 down to the beginning of the instep 32.

An elastic concentration 12B spans from the a back of the toe region 12A down the instep 32 for a distance of not less than ¼ inch to not more than 1 inch. The elastic concentration 12B begins just after a ball 34 (widest part of the foot 30), which is just past the joints of the toes 31.

An opening region 12C spans from the elastic concentration 12B to an opening 15. It shall be noted that the elastic concentration 12B has the highest density of elasticity when compared to the toe region 12A and the opening region 12C. The toe region 12A has the second highest density of elasticity when compared to the opening region 12C and the elastic concentration 12B. The opening region 12C has the lowest density of elasticity. It is important that the opening region 12C have the least elasticity so the invention 10 will be able to easily install upon the foot 30 as well as to remove the invention 10 via a toe from an opposing foot. The elastic concentration 12B has the highest level of elasticity so that the invention 10 can be securely positioned around the ball 34 of the foot 30 and thus maintain the placement of the invention 10 thereon.

The size, shape, and elasticity of the invention 10 insures that the invention 10 will securely stay upon the foot 30 while enabling an end user to remove the invention 10 by inserting a toe from an opposing foot into the opening region 12C along the bottom of the invention 10 at the instep 36 of the foot 30. It is the inclusion of the three regions of the elastic layer 12 that provides the ease in use and removal of the invention 10.

With respect to the above description, it is to be realized that the optimum dimensional relationship for the various components of the invention 10, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 10.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A bed sock comprising:

a fabric layer and an elastic layer;

wherein the elastic layer is a layer of elastic yarns that is further defined and composed of a toe region, an elastic concentration region, and an opening region;

wherein the fabric layer and the elastic layer are each configured to span from toes of a foot to an end of a Metatarsus;

wherein the elastic layer is comprised of a plurality of elastic bands that encircle said sock; wherein said elastic layer is an interwoven fabric layer that includes the plurality of elastic bands therein.

2. The bed sock as described in claim 1 wherein the toe region of the elastic layer spans from the toes of the foot to a ball of the foot.

3. The bed sock as described in claim 2 wherein the elastic concentration of the elastic layer spans from behind the ball of the foot to a distance of not less than ¼ inch to not more than 1 inch.

4. The bed sock as described in claim 3 wherein the opening region spans from a back of the elastic concentration to an opening of said sock.

5. The bed sock as descried in claim 3 wherein the elastic concentration has a highest density of elasticity when compared to the toe region and the opening region.

6. The bed sock as described in claim 5 wherein the opening region has a lower density of elasticity when compared to the toe region.

7. The bed sock as described in claim 1 wherein the layer of fabric is made of a material comprising polyester, cotton, a blend of polyester and cotton, silk, wool, and nylon.

8. A bed sock comprising:

a fabric layer and an elastic layer;

wherein the elastic layer is a layer of elastic yarns that is further defined and composed of a toe region, an elastic concentration region, and an opening region;

wherein the fabric layer and the elastic layer are each configured to span from toes of a foot to a beginning of an instep;

wherein the elastic layer is comprised of a plurality of elastic bands that encircle said sock;

wherein said elastic layer is an interwoven fabric layer that includes the plurality of elastic bands therein.

9. The bed sock as described in claim 8 wherein the toe region of the elastic layer spans from the toes of the foot to behind a ball of the foot.

10. The bed sock as described in claim 9 wherein the elastic concentration of the elastic layer spans from behind the ball of the foot to a distance of not less than ¼ inch to not more than 1 inch.

11. The bed sock as described in claim 10 wherein the opening region spans from the elastic concentration to an opening of said sock.

12. The bed sock as described in claim 10 wherein the elastic concentration has a highest density of elasticity when compared to the toe region and the opening region.

13. The bed sock as described in claim 12 wherein the opening region has a lower density of elasticity when compared to the toe region.

14. The bed sock as described in claim 8 wherein the layer of fabric is made of a material comprising polyester, cotton, a blend of polyester and cotton, silk, wool, and nylon.

15. A bed sock comprising:

a fabric layer and an elastic layer;

wherein the elastic layer is a layer of elastic yarns that is further defined and composed of a toe region, an elastic concentration region, and an opening region;

wherein the fabric layer and the elastic layer are each configured to span from toes of a foot to an end of a Metatarsus;

wherein the elastic layer is comprised of a plurality of elastic bands that encircle said sock;

wherein said elastic layer is an interwoven fabric layer that includes the plurality of elastic bands therein wherein the toe region the elastic layer spans from the toes of the foot to behind a ball of the foot; wherein the elastic concentration of the elastic layer spans from the ball of the foot to a distance of not less than ¼ inch to not more than 1 inch; and wherein the opening region spans from the elastic concentration to an opening of said sock.

16. The bed sock as described in claim 15 wherein the elastic concentration has a highest density of elasticity when compared to the toe region and the opening region; and wherein the opening region has a lower density of elasticity when compared to the toe region.

17. The bed sock as described in claim 15 wherein the layer of fabric is made of a material comprising polyester, cotton, a blend of polyester and cotton, silk, wool, and nylon.

* * * * *